US008074805B2

(12) United States Patent
Zhao et al.

(10) Patent No.: US 8,074,805 B2
(45) Date of Patent: Dec. 13, 2011

(54) EXTRA-LARGE VIBRATING SCREEN WITH DUPLEX STATICALLY INDETERMINATE MESH BEAM

(75) Inventors: Yuemin Zhao, Xuzhou (CN); Chengyong Zhang, Xuzhou (CN)

(73) Assignee: China University of Mining and Technology, Jiangsu (CN)

( * ) Notice: Subject to any disclaimer, the term of this patent is extended or adjusted under 35 U.S.C. 154(b) by 707 days.

(21) Appl. No.: 12/223,412

(22) PCT Filed: Dec. 19, 2007

(86) PCT No.: PCT/CN2007/003684

§ 371 (c)(1),
(2), (4) Date: Jul. 29, 2008

(87) PCT Pub. No.: WO2008/086695

PCT Pub. Date: Jul. 24, 2008

(65) Prior Publication Data

US 2009/0026113 A1 Jan. 29, 2009

(51) Int. Cl.
*B07B 1/28* (2006.01)

(52) U.S. Cl. ..... 209/315; 209/236; 209/309; 209/322; 209/364; 209/409

(58) Field of Classification Search ..... 209/236, 209/309, 315, 322, 364, 409, 412
See application file for complete search history.

(56) References Cited

U.S. PATENT DOCUMENTS

| | | | | | |
|---|---|---|---|---|---|
| 1,621,949 | A | * | 3/1927 | Overstrom | 209/366.5 |
| 3,704,782 | A | * | 12/1972 | Hahn | 209/326 |
| 4,021,337 | A | * | 5/1977 | Wehren | 209/329 |
| 4,319,993 | A | * | 3/1982 | Krause | 209/315 |

FOREIGN PATENT DOCUMENTS

| | | | |
|---|---|---|---|
| CN | 2329456 | Y | 7/1999 |
| CN | 1446642 | A | 10/2003 |
| CN | 101011696 | A | 8/2007 |
| CN | 200995190 | Y | 12/2007 |
| DE | 2 216 130 | | 10/1973 |

OTHER PUBLICATIONS

International Search Report, dated Mar. 6, 2008, corresponding to PCT/CN2007/003684.

* cited by examiner

*Primary Examiner* — Terrell Matthews
(74) *Attorney, Agent, or Firm* — Christie, Parker & Hale, LLP

(57) ABSTRACT

An extra-large vibrating screen with duplex statically indeterminate mesh beam excitation body and plate type combined bearing beam comprises plate type flat and rigid statically indeterminate combined bearing beam (12) arranged in a screen box (1), a plurality of Y-shaped statically indeterminate combined reinforcing beams (5) arranged on the side plates (3) of the screen box alternately, duplex statically indeterminate supporting plates (22) linking a plurality of mesh beams (21) to the statically indeterminate connecting plate (4) and the side plate (3) so as to form a container made of a beam system, the vibration exciters (10) in the statically indeterminate mesh beam unit comprising eight sets of vibration exciters, which are aligned in pair horizontally and linked together through universal couplings (9), and connected to the duplex statically indeterminate mesh beam excitation body (11) to form a highly rigid integral vibrating assembly. The vibrating screen is simple and reliable in structure, can vibrate smoothly, and therefore can be widely used in coal, metallurgical, chemical, and environmental protection industries.

18 Claims, 4 Drawing Sheets

EXTRA-LARGE VIBRATING SCREEN WITH DUPLEX STATICALLY INDETERMINATE MESH BEAM

CROSS-REFERENCE TO RELATED APPLICATION(S)

This application is a National Phase Patent Application and claims the priority of International Application Number PCT/CN2007/003684, filed on Dec. 19, 2007, which claims priority of Chinese Patent Application Number 200710019307.6, filed on Jan. 15, 2007.

FIELD OF THE INVENTION

The present invention relates to extra-large vibrating screen with duplex statically indeterminate mesh beam excitation body and plate type combined bearing beam, which is especially applicable to size-grading, dehydration, desliming, and medium draining for coal and other materials.

BACKGROUND OF THE INVENTION

Vibrating screen is a main equipment in coal preparation plants. The vibrating screens have a large scale of quantities, variety of specifications and frequent incidents. Especially, large-scale vibrating screen is the key equipment in technical renovation in new and old large-scale coal preparation plants in China. The efficacy and reliability of the screening, dehydration, and medium draining processes of the vibrating screen have direct influence on the economic benefit of the coal preparation plants. However, due to technical defects, homemade large-scale vibrating screen cannot meet the actual demands in production in coal mines and coal preparation plants yet. In design, conventional vibrating screens usually employ I-beams or rectangular steel beams as the support for the vibration exciters. The I-beam or rectangular steel beams are only of bearing function. Therefore, the vibration exciters are large in size and heavy in weight, and thus the vibration mass of the screen frame is heavy. Once the width of cross section of the screen frame is over 3 m, the structural dimensions and weight of the main beam will be increased severely, causing difficulties in machining and assembling of the main beam and tube beams. For any vibrating screen with cross section wider than 3 m, a simple grease-lubricated vibration exciter cannot deliver the exciting force required by the vibrating components for the heavy vibration mass; consequently, a low-speed thin oil lubricated vibration exciter with big bearings has to be used. Especially, a linear screen has to be implemented with a synchronizer and synchronizing gears. Due to the limitation of the material and technical level of machining, fracture of the tube beams and cracking of the side plates often occur during the operation of vibrating screen, which not only degrade the production efficiency but also shorten the service life of the screening machine. That trouble is a key factor that has hindered the designers to increase the width of cross section of the screen frame and improve the structural parameters for years. In Patent Application No. ZL02112809.x, a large-scale vibrating screen of statically indeterminate mesh beam excitation was disclosed, which solved the problem in the structural steel of the screen body and exciting force matching for the large-scale vibrating screen with cross section wider than 3 m. However, in that technical scheme, if the width of the cross section of the screen frame is over 3.6 m, the problems in overall structural rigidity of the screen frame, structure of bearing beam, and reliability of the vibrating screen become severe, and directly influence the reliability, service life, and operating efficacy of the vibrating screen. Such problems have limited the development of extra-large vibrating screens. Since the vibrating screen size cannot be increased, more vibrating screens have to be used to meet the demand of production; consequently, the construction cost and production management cost are increased. At present, most large-scale and extra-large vibrating screens in China are imported products. Over these years, it has been an urgent demand to develop large-scale vibrating screens and implement technical localization in the development of technical level of coal preparation and mass production.

SUMMARY OF THE INVENTION

In view of the problems in the prior art, the object of the present invention is to provide an extra-large vibrating screen with duplex statically indeterminate mesh beam excitation body and plate type combined bearing beam.

In order to attain the object, the present invention provides an extra-large vibrating screen, which comprises a screen box, an elastic bearing body that supports the screen box, a statically indeterminate mesh beam unit, motors, and tire-type flexible couplings, wherein, a plate type statically indeterminate combined bearing beam is arranged in the screen box, and rectangular close beams connected to the combined bearing beam are arranged at the discharge side and the feeding side; a plurality of Y-shaped statically indeterminate combined reinforcing beams are arranged on the side plates of the screen box at certain spacing; the mesh beams of the statically indeterminate mesh beam unit serve as a duplex statically indeterminate mesh beam excitation body, which links a plurality of mesh beams linked via duplex statically indeterminate supporting plates to the statically indeterminate connecting plate and the side plate so as to form a container made of a beam system; the vibration exciters in the statically indeterminate mesh beam unit comprise eight sets of vibration exciters, which are aligned in pair horizontally and linked together through universal couplings, and connected to the duplex statically indeterminate mesh beam body to form a highly rigid integral vibrating assembly.

The plate type rigid statically indeterminate combined bearing beam comprises a statically indeterminate supporting plate, a plurality of beams fixed to the statically indeterminate supporting plate, and statically indeterminate connecting plates fixed to the outer side of the beams; the two ends of the statically indeterminate supporting plate for the statically indeterminate combined bearing beam are right-angle plates, and the two end faces of the front and rear right-angle plates are fixed to the rectangular close beams; there is an opening between the rectangular close beam at the discharge side and the combined bearing beam, but between the rectangular close beam at the feeding side and the combined bearing beam is closed; the Y-shaped statically indeterminate combined reinforcing beam comprises supporting tubes, a side plate, and a statically indeterminate plate, wherein, the supporting tubes are aligned in Y-shape between the side plate and the statically indeterminate plate; the motors and the tire-type flexible couplings are in two sets, and are arranged beside the side plates of the screen box in symmetry.

The extra-large vibrating screen provided in the present invention is applicable to size-grading, dehydration, desliming, and medium draining for coal. According to the requirement for exciting force and vibration direction angle, the load on the main beam is distributed on the statically indeterminate supporting plates proportionally, and the mesh beam body participates in the vibration directly; therefore, the I-beam or rectangular steel beam that serves as the main frame to support the vibration exciters in the prior art is omitted, and thereby the mass of vibration is decreased. The plate type statically indeterminate combined bearing beam structure constitutes an integral planar rigid body, and therefore the overall bending and torsion resistance of the screen frame is improved. The vibration exciters in mesh beam excitation body structure are small in size, the mass of vibration of the vibrating screen is light in weight, the individual vibrating components have reduced exciting force and higher movement accuracy; therefore, the width of cross section of the screen frame can be increased effectively, and the unit yield rate and efficiency can be improved. The vibrating screen is characterized by simple, compact, and reliable structure, high rigidity, high strength against vibration, good structure, and smooth and reliable vibration performance, and the entire unit can be transported and installed as components. Due to the reliable structure, the overall mechanical performance of the vibrating screen is improved, and therefore the vibrating screen can meet the demand in production in large-scale coal mines and coal preparation plants, and can be widely applied in coal, metallurgical, chemical, and environmental protection industries.

BRIEF DESCRIPTION OF THE SYMBOLS

| | | | |
|---|---|---|---|
| 1 | Screen box | 2, 8 | Rectangular close beam |
| 3 | Side plate of screen box | 4, 16 | Statically indeterminate connecting plate |
| 5 | Y-shaped statically indeterminate combined reinforcing beam | 6 | Cross beam |
| 7 | Elastic bearing body | 9 | Universal coupling |
| | | 10 | Vibration exciter |
| 11 | Duplex statically indeterminate mesh beam excitation body | 12 | Statically indeterminate combined bearing beam |
| 13 | Screen plate | 14 | Tire-type flexible coupling |
| 15 | Motor | 17, 22 | Statically indeterminate supporting plate |
| 18 | Supporting tube | 19 | Side plate |
| 20 | Statically indeterminate plate | 21 | Mesh beam |

DETAILED DESCRIPTION

An embodiment of the present invention will be described in further detail herein, with reference to the accompanying drawings.

Figure 1:
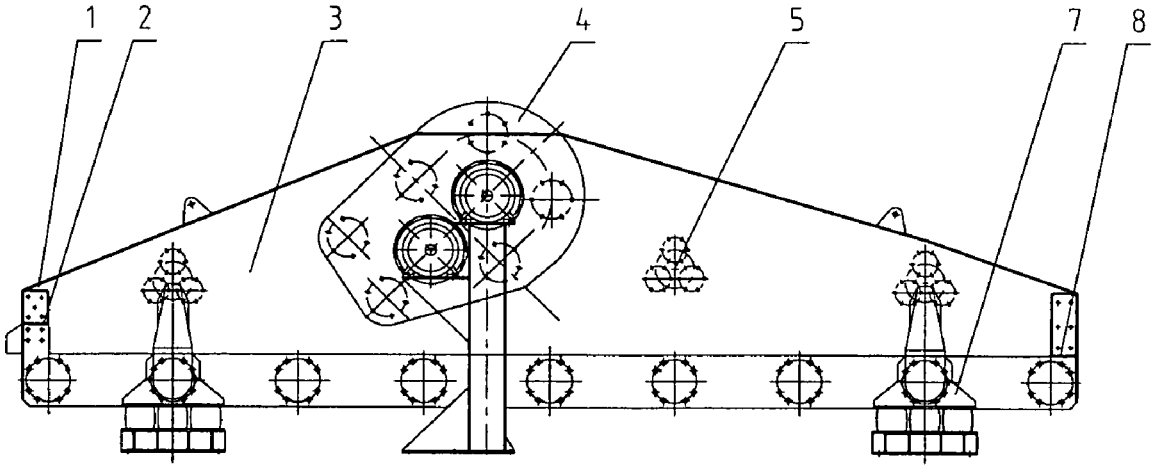
FIG. 1 is a front view of the structure of the vibrating screen provided in the present invention.
Figure 2:
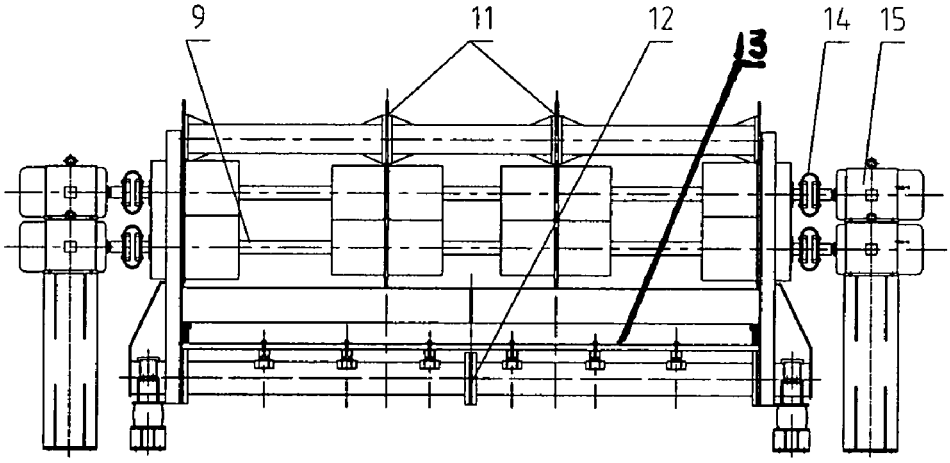
FIG. 2 is a side view of the structure of the vibrating screen provided in the present invention.
Figure 3C:
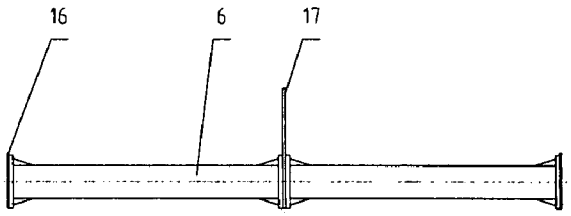
FIGS. 3*a*, 3*b*, and 3*c* are a structural representation of the plate type statically indeterminate combined bearing beam in the present invention.
Figure 3A:
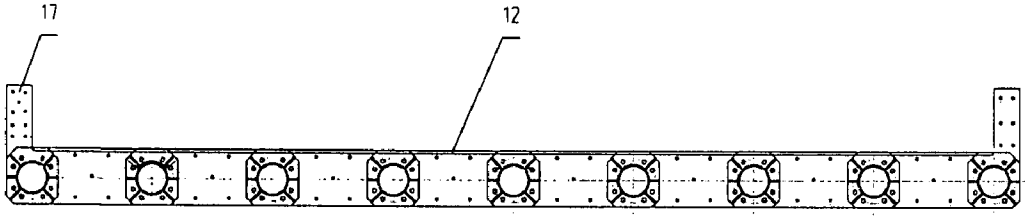
Figure 3B:
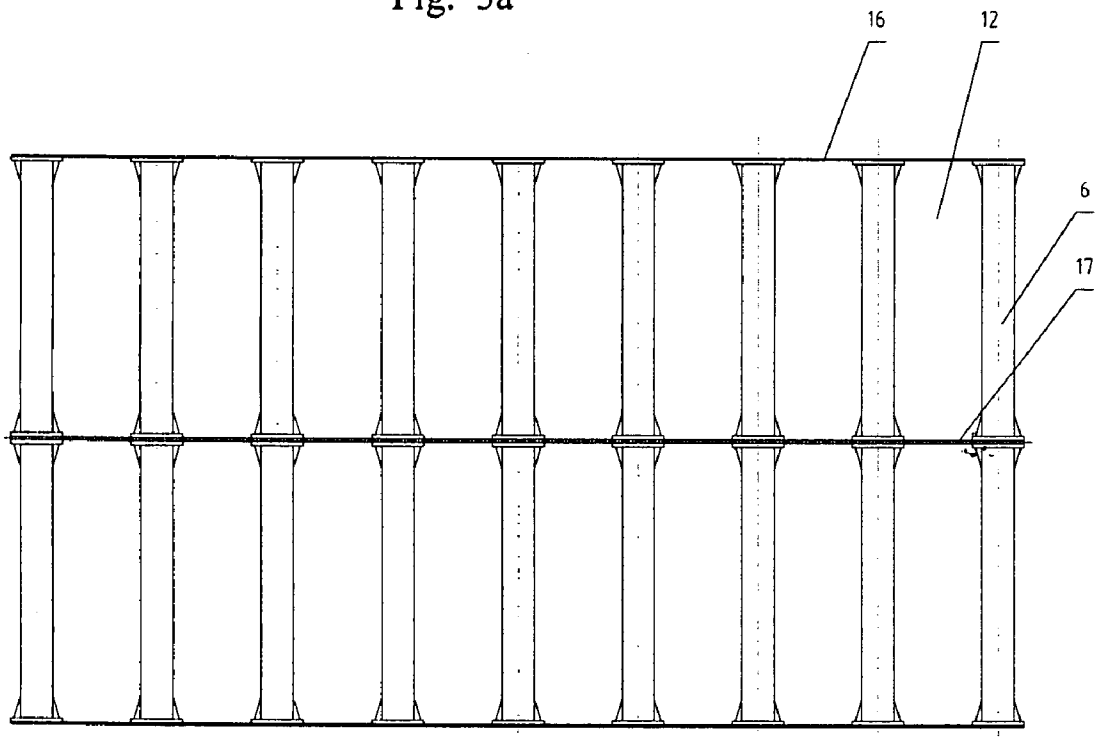
Figure 4B:
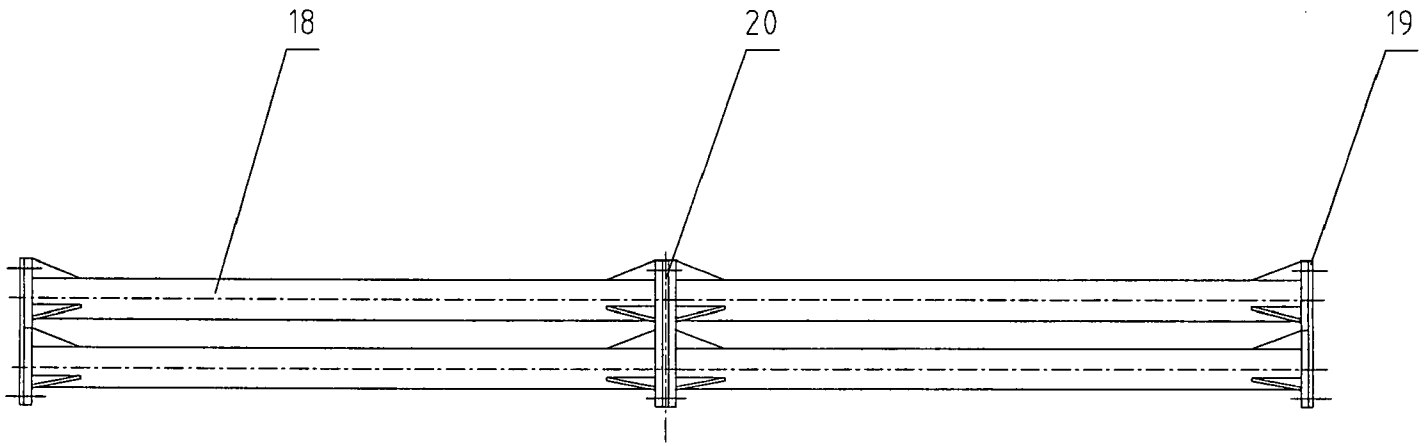
FIGS. 4*a* and 4*b* are a structural representation of the Y-shaped statically indeterminate combined reinforcing beam in the present invention.
Figure 4A:
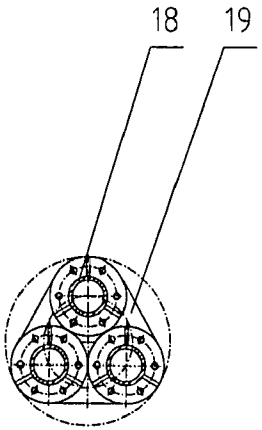
Figure 5B:
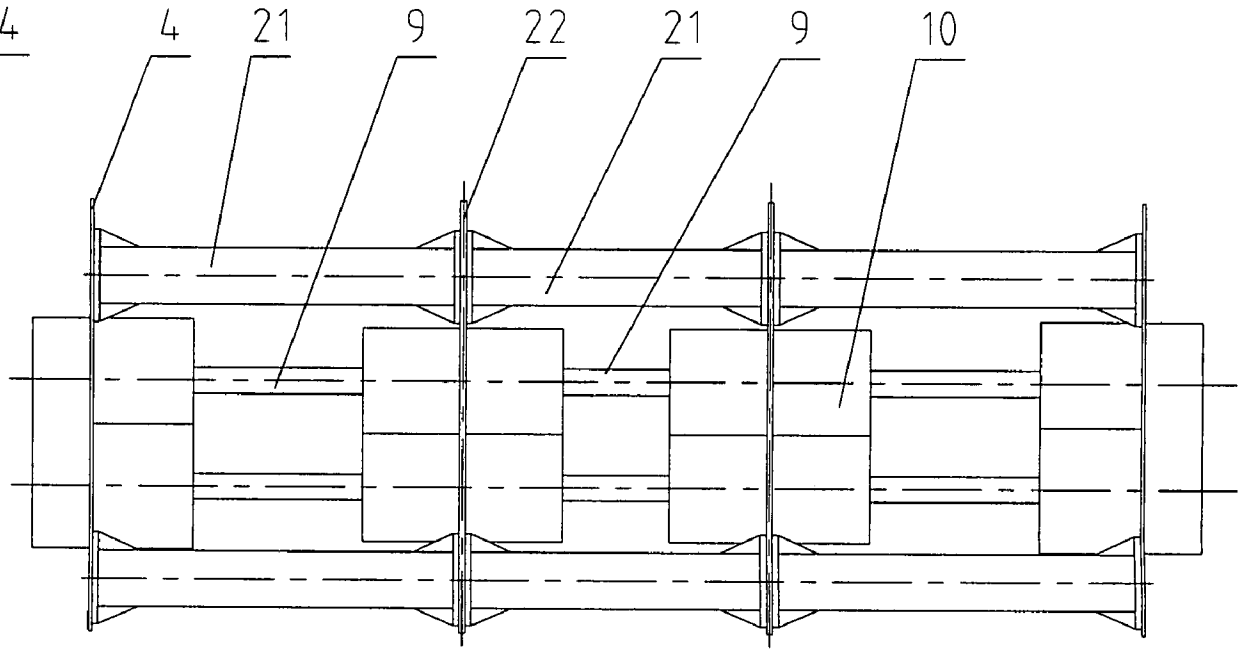
FIGS. 5*a* and 5*b* are a structural representation of the duplex statically indeterminate mesh beam excitation body.
Figure 5A:
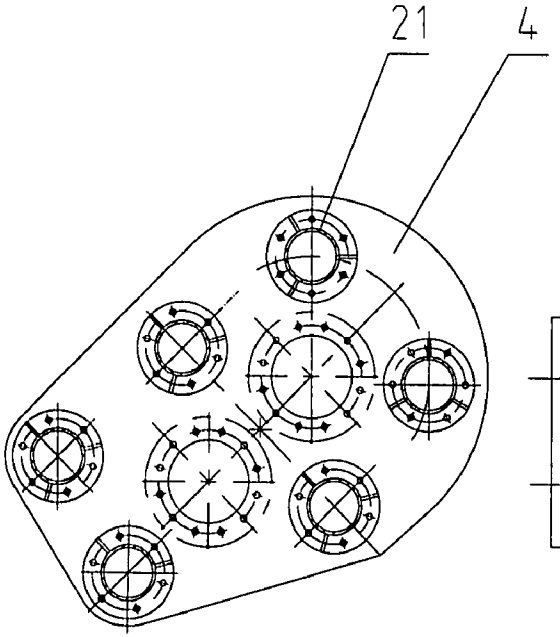

As shown in FIG.1 and FIG.2, extra-large vibrating screen with duplex statically indeterminate mesh beam excitation body and plate type combined bearing beam mainly comprises a screen box 1, an elastic bearing body 7, a statically indeterminate combined bearing beam 12, motors 15, tire-type flexible couplings 14, statically indeterminate mesh beams 21, and rectangular close beams 2 and 8 arranged at the discharge side and feeding side of the screen box 1. The elastic bearing body 7 that supports the screen box 1 comprises an upper seat of spring, a rubber spring, and a lower seat of spring. A statically indeterminate combined bearing beam 12 is arranged under the screen plate 13 in the screen box 1, and is a plate type flat rigid body. As shown in FIGS. 3*a*, 3*b*, 3*c*, the statically indeterminate combined bearing beam 12 comprises a statically indeterminate supporting plate 17, a plurality of cross beams 6 fixed on two sides of the statically indeterminate supporting plate 17, and statically indeterminate connecting plates 16 fixed on the sides of the cross beams 6. The two ends of the statically indeterminate supporting plate 17 are right angle plates, and the two end faces of the front and rear right angle plates are fixed to the rectangular close beams 2 and 8. As the rectangular close beams 2 and 8 are fixed to the side plates 3 of the screen box, as illustrated in FIG. 1, the statically indeterminate combined bearing beam 12 is also fixed to the side plates 3, as well as through the connecting plates 16, as shown in FIG. 2. Further, the screen plate 13 is supported on the statically indeterminate combined bearing beam 12, as illustrated in FIG. 2. There is an opening between the rectangular close beam 2 at the discharging side and the statically indeterminate combined bearing beam 12, and a sealing between the rectangular close beam 8 at the feeding side and the statically indeterminate combined bearing beam 12. In order to ensure high rigidity of the screen box 1, a plurality of Y-shaped statically indeterminate combined reinforcing beams 5 are distantly arranged on the side plate 3 of the screen box 1 at locations spaced apart from statically indeterminate mesh beam unit, as shown in FIG. 1. As shown in FIGS. 4*a*, 4*b*, the Y-shaped statically indeterminate combined reinforcing beam 5 comprises supporting tubes 18, side plates 19, and statically indeterminate plates 20, wherein, the supporting tubes 18 are aligned in Y-shape between the side plates 19 and the statically indeterminate plate 20. The mesh beam of the statically indeterminate mesh beam unit is a duplex statically indeterminate mesh beam excitation body 11. As shown in FIGS. 5*a*, 5*b*, the mesh beam of the statically indeterminate mesh beam unit is a duplex statically indeterminate mesh beam excitation body 11 comprised of a plurality of mesh beams 21, duplex statically indeterminate supporting plates 22, and connecting plates 4, which links the plurality of mesh beams 21 linked via the duplex statically indeterminate supporting plates 22 to the statically indeterminate connecting plate 4 and the side plate 3 of the screen box 1 so as to form a container made of a beam system. The vibration exciter 10 comprises eight sets of vibration exciters aligned in pairs which are linked with the universal couplings 9 at the ends and in the middle and then are connected with the duplex statically indeterminate mesh beam excitation body 11 to form an integral mesh beam highly rigid excitation body comprised of the statically indeterminate mesh beam excitation body 11, the vibration exciter 10, and the universal couplings 9. Two sets of motors 15 and tire-type flexible couplings 14 are arranged at the two sides of the side plate 3 of the screen box 1 in symmetry; the tire-type flexible couplings 14 and the universal couplings 9 at the ends and in the middle form a drive unit. The duplex statically indeterminate mesh beam excitation body 11 is fixed to the side plate 3 of the screen box 1, and the screen box 1 is supported on the elastic bearing body 7; the power source is transmitted from the motors 15 mounted on the motor base through the drive unit that comprises the tire-type flexible couplings 14 and universal couplings 9 at the ends and in the middle to the vibration exciters fixed on the duplex statically indeterminate mesh beam excitation body 11, so as to produce combined exciting force to meet the demand of screening, dehydration, and medium draining operations of the vibrating components.

The invention claimed is:

1. A vibrating screen apparatus with duplex statically indeterminate mesh beam excitation body and plate type combined bearing beam, the vibrating screen apparatus comprising: a screen box (1) including a side plate (3); a screen plate (13) the screen box (1); an elastic bearing body (7) supporting the screen box (1); a statically indeterminate mesh beam unit fixed to the side plate (3); motors (15); tire-type flexible couplings (14); a plate type statically indeterminate combined bearing beam (12) fixed to the side plate (3) and arranged under the screen plate (13); rectangular close beams (2, 8) connected to the combined bearing beam (12) and arranged at a discharging side of the screen box (1) and a feeding side of the screen box 1,; and a plurality of Y-shaped statically indeterminate combined reinforcing beams (5) arranged on the side plate (3) of the screen box at locations spaced apart from the statically indeterminate mesh beam unit; wherein the statically indeterminate mesh beam unit comprises a duplex statically indeterminate mesh beam excitation body (11) including a plurality of mesh beams (21) linked via duplex statically indeterminate supporting plates (22) to a statically indeterminate connecting plate (4) and the side plate (3) of the screen box so as to form a beam system; and wherein the vibrating screen apparatus further comprises a vibration exciter (10) connected with the statically indeterminate mesh beam excitation body (11) and comprising eight sets of vibration exciters horizontally aligned in pairs, linked via universal couplings (9) and connected to motors (15) through the tire-type flexible couplings (14).

2. The vibrating screen apparatus according to claim 1, wherein, the plate type statically indeterminate combined bearing beam (12) comprises a statically indeterminate supporting plate (17), a plurality of beams (6) fixed to the statically indeterminate supporting plate (17), and statically indeterminate connecting plates (16) fixed to the ends of the beams (6).

3. The vibrating screen apparatus according to claim 2, wherein, two ends of the statically indeterminate supporting plate (17) of the statically indeterminate combined bearing beam (12) include front and rear right angle plates, and two end faces of the front and rear right angle plates are fixed to the rectangular close beams (2, 8), wherein, there is an opening between the rectangular close beam (2) at the discharging side and the combined bearing beam (12), and between the rectangular close beam (8) at the feeding side and the combined bearing beam (12) is closed.

4. The vibrating screen apparatus according to claim 1, wherein, each of the plurality of Y-shaped statically indeterminate combined reinforcing beams (5) comprises supporting tubes (18), a side plate (19), and a statically indeterminate plate (20), wherein, the supporting tubes (18) are aligned in Y-shape between the side plate (19) and the statically indeterminate plate (20).

5. The vibrating screen apparatus according to claim 1, wherein, the motors (15) and the tire-type flexible couplings (14) comprise two sets, and are arranged at sides of the side plate (3) of the screen box in symmetry.

6. The vibrating screen apparatus according to claim 1, wherein, the plate type statically indeterminate combined bearing beam (12) comprises a statically indeterminate supporting plate (17), wherein, two ends of the statically indeterminate supporting plate (17) of the statically indeterminate combined bearing beam (12) include front and rear right angle plates, and two end faces of the front and rear right angle plates are fixed to the rectangular close beams (2, 8), wherein, there is an opening between the rectangular close beam (2) at the discharging side and the combined bearing beam (12), and between the rectangular close beam (8) at the feeding side and the combined bearing beam (12) is closed.

7. A vibrating screen apparatus with duplex statically indeterminate mesh beam excitation body and plate type combined bearing beam, the vibrating screen apparatus comprising: a screen box (1) including a side plate (3); a screen plate (13) in the screen box (1); an elastic bearing body (7) supporting the screen box (1); a statically indetermininate mesh beam unit fixed to the side plate (3); motors (15); tire-type flexible couplings (14); a plate type statically indeterminate combined bearing beam (12) fixed to the side plate (3) and arranged under the screen late (13); rectangular close beams (2, 8) connected to the combined bearing beam (12) and arranged at a discharging side of the screen box (1) and a feeding side of the screen box (1); and a plurality of Y-shaped statically indeterminate combined reinforcing beams (5) arranged on the side plate (3) of the screen box at locations spaced apart from the statically indeterminate mesh beam unit; wherein the statically indeterminate mesh beam unit comprises a duplex statically indeterminate mesh beam excitation body (11) including a plurality of mesh beams (21) linked via duplex statically indeterminate supporting plates (22) to a statically indeterminate connecting plate (4) and the side plate (3) of the screen box so as to form a beam system.

8. The vibrating screen apparatus according to claim 7, further comprising a vibration exciter (10) connected with the statically indeterminate mesh beam excitation body (11). the vibration exciter (10) comprising a plurality of sets of vibration exciters horizontally aligned in pairs, linked via universal couplings (9) and connected to the motors (15) through the tire-type flexible couplings (14).

9. The vibrating screen apparatus according to claim 8, wherein, the plate type statically indeterminate combined bearing beam (12) comprises a statically indeterminate supporting plate (17), a plurality of beams (6) fixed to the statically indeterminate supporting plate (17), and statically indeterminate connecting plates (16) fixed to the ends of the beams (6).

10. The vibrating screen apparatus according to claim 9, wherein, two ends of the statically indeterminate supporting plate (17) of the statically indeterminate combined bearing beam (12) include front and rear right angle plates, and two end faces of the front and rear right angle plates are fixed to the rectangular close beams (2, 8), wherein, there is an opening between the rectangular close beam (2) at the discharging side and the combined bearing beam (12), and between the rectangular close beam (8) at the feeding side and the combined bearing beam (12) is closed.

11. The vibrating screen apparatus according to claim 8, wherein, each of the plurality of Y-shaped statically indeterminate combined reinforcing beams (5) comprises supporting tubes (18), a side plate (19), and a statically indeterminate plate (20), wherein, the supporting tubes (18) are aligned in Y-shape between the side plate (19) and the statically indeterminate plate (20).

12. The vibrating screen apparatus according to claim 8, wherein, the motors (15) and the tire-type flexible couplings (14) comprise two sets, and are arranged at sides of the side plate (3) of the screen box in symmetry.

13. The vibrating screen apparatus according to claim 8, wherein, the plate type statically indeterminate combined bearing beam (12) comprises a statically indeterminate supporting plate (17), wherein, two ends of the statically indeterminate supporting plate (17) of the statically indeterminate combined bearing beam (12) include front and rear right angle plates, and two end faces of the front and rear right angle plates are fixed to the rectangular close beams (2, 8), wherein, there is an opening between the rectangular close beam (2) at the discharging side and the combined bearing beam (12), and between the rectangular close beam (8) at the feeding side and the combined bearing beam (12) is closed.

14. The vibrating screen apparatus according to claim 7, wherein, the plate type statically indeterminate combined bearing beam (12) comprises a statically indeterminate supporting plate (17), a plurality of beams (6) fixed to the statically indeterminate supporting plate (17), and statically indeterminate connecting plates (16) fixed to the ends of the beams (6).

15. The vibrating screen apparatus according to claim 14, wherein, two ends of the statically indeterminate supporting plate (17) of the statically indeterminate combined bearing beam (12) include front and rear right angle plates, and two end faces of the front and rear right angle plates are fixed to the rectangular close beams (2, 8), wherein, there is an opening between the rectangular close beam (2) at the discharging side and the combined bearing beam (12), and between the rectangular close beam (8) at the feeding side and the combined bearing beam (12) is closed.

16. The vibrating screen apparatus according to claim 7, wherein, each of the plurality of Y-shaped statically indeterminate combined reinforcing beams (5) comprises supporting tubes (18), a side plate (19), and a statically indeterminate plate (20), wherein, the supporting tubes (18) are aligned in Y-shape between the side plate (19) and the statically indeterminate plate (20).

17. The vibrating screen apparatus according to claim 7, wherein, the motors (15) and the tire-type flexible couplings (14) comprise two sets, and are arranged at sides of the side plate (3) of the screen box in symmetry.

18. The vibrating screen apparatus according to claim 7, wherein, the plate type statically indeterminate combined bearing beam (12) comprises a statically indeterminate supporting plate (17), wherein, two ends of the statically indeterminate supporting plate (17) of the statically indeterminate combined bearing beam (12) include front and rear right angle plates, and two end faces of the front and rear right angle plates are fixed to the rectangular close beams (2, 8), wherein, there is an opening between the rectangular close beam (2) at the discharging side and the combined bearing beam (12), and between the rectangular close beam (8) at the feeding side and the combined bearing beam (12) is closed.

* * * * *

UNITED STATES PATENT AND TRADEMARK OFFICE

CERTIFICATE OF CORRECTION

PATENT NO. : 8,074,805 B2
APPLICATION NO. : 12/223412
DATED : December 13, 2011
INVENTOR(S) : Yuemin Zhao et al.

It is certified that error appears in the above-identified patent and that said Letters Patent is hereby corrected as shown below:

In the Claims

| | |
|---|---|
| Column 5, Claim 1, line 10. | After "(13)" Insert -- in -- |
| Column 5, Claim 1, line 18. | Delete "1,;" Insert -- (1); -- |
| Column 5, Claim 1, line 32. | After "to" Insert -- the -- |
| Column 6, Claim 7, line 12. | Delete "indetermininate" Insert -- indeterminate -- |
| Column 6, Claim 7, line 16. | Delete "late" Insert -- plate -- |
| Column 6, Claim 8, line 31. | Delete "(11)." Insert -- (11), -- |

Signed and Sealed this
Twenty-ninth Day of May, 2012

David J. Kappos

David J. Kappos
*Director of the United States Patent and Trademark Office*